US011718983B2

(12) United States Patent
Thoma

(10) Patent No.: US 11,718,983 B2
(45) Date of Patent: Aug. 8, 2023

(54) BALCONY SYSTEM WITH COUNTERFORCE UNIT

(71) Applicant: piboi GmbH, Freiburg (DE)

(72) Inventor: Johannes Thoma, Bottmingen (CH)

(73) Assignee: piboi GmbH, Freiburg (DE)

( * ) Notice: Subject to any disclaimer, the term of this patent is extended or adjusted under 35 U.S.C. 154(b) by 0 days.

(21) Appl. No.: 17/296,904

(22) PCT Filed: Nov. 26, 2019

(86) PCT No.: PCT/EP2019/082594
§ 371 (c)(1),
(2) Date: May 25, 2021

(87) PCT Pub. No.: WO2020/109308
PCT Pub. Date: Jun. 4, 2020

(65) Prior Publication Data

US 2022/0034080 A1 Feb. 3, 2022

(30) Foreign Application Priority Data

Nov. 26, 2018 (DE) ..... 10 2018 129 776.9

(51) Int. Cl.
*E04B 1/343* (2006.01)
*E04B 1/00* (2006.01)

(52) U.S. Cl.
CPC ..... *E04B 1/34357* (2013.01); *E04B 1/003* (2013.01)

(58) Field of Classification Search
CPC ..... E04B 1/34357; E04B 1/003
(Continued)

(56) References Cited

U.S. PATENT DOCUMENTS 2,296,413 A * 9/1942 Zell ..... E04B 1/34336 52/64
2,499,498 A * 3/1950 Hammond, Jr. ..... E04H 1/005 414/277

(Continued)

FOREIGN PATENT DOCUMENTS

AT 407271 B 9/2008
EP 1614825 B1 9/2008

(Continued)

OTHER PUBLICATIONS

International Search Report for International Application No. PCT/EP2019/082594 dated Feb. 17, 2020.

(Continued)

*Primary Examiner* — Brian D Mattei
*Assistant Examiner* — Joseph J. Sadlon
(74) *Attorney, Agent, or Firm* — Meunier Carlin & Curfman LLC

(57) ABSTRACT

A balcony system for use with a building opening of a building structure is provided. The balcony system includes a balcony unit adapted to project from the building opening, a counterforce unit adapted to compensate for forces applied to the balcony unit, and a first connecting element connecting the balcony unit and the counterforce unit. The counterforce unit comprises a base unit, a top unit on the base unit, and a second connecting element. The base unit is configured for stationary installation with respect to the building structure, such as for stationary installation on a floor of the building structure. The first connecting element connects the balcony unit and the top unit. The second connecting element connects the top unit and the base unit. The top unit is movable relative to the base unit.

20 Claims, 8 Drawing Sheets

(58) Field of Classification Search
USPC ..... 52/64
See application file for complete search history.

(56) References Cited

U.S. PATENT DOCUMENTS

| | | | | | |
|---|---|---|---|---|---|
| 3,162,277 | A * | 12/1964 | Markle | E04B 1/0023 | 52/261 |
| 3,544,186 | A * | 12/1970 | Bjorge | A47B 88/487 | 312/331 |
| 4,277,920 | A * | 7/1981 | Dixon | E04B 1/34336 | 52/64 |
| 4,464,868 | A * | 8/1984 | Howroyd | E04B 1/3444 | 52/68 |
| 4,697,392 | A * | 10/1987 | Silzle | E04B 1/346 | 244/114 R |
| 4,900,217 | A * | 2/1990 | Nelson | B60P 1/431 | 14/71.1 |
| 5,103,934 | A * | 4/1992 | Brooks | E04F 11/068 | 182/86 |
| 5,491,933 | A * | 2/1996 | Miller | B60P 3/34 | D12/104 |
| 5,588,500 | A * | 12/1996 | Yonahara | E04G 1/22 | 182/115 |
| 5,979,116 | A * | 11/1999 | Myoga | E04H 3/126 | 52/6 |
| 6,681,531 | B2 * | 1/2004 | McManus | B60P 3/34 | 52/143 |
| 6,772,563 | B2 * | 8/2004 | Kuhn | E04B 1/34305 | 52/79.5 |
| 6,851,734 | B2 * | 2/2005 | Findley | B62D 61/12 | 296/171 |
| 6,874,283 | B1 | 4/2005 | Hindle | | |
| 7,290,378 | B2 * | 11/2007 | Kalnay | E04B 1/3441 | 52/79.5 |
| 8,733,813 | B2 * | 5/2014 | Blackwell | A61G 10/00 | 296/24.38 |
| 9,809,970 | B2 * | 11/2017 | Burns | E04H 15/50 | |
| 10,538,907 | B2 * | 1/2020 | Dooley | E04B 2/86 | |
| 10,584,500 | B2 * | 3/2020 | Tann | E04B 1/0023 | 52/261 |
| 10,703,591 | B2 * | 7/2020 | Preston | B65G 69/22 | |
| 11,007,921 | B2 * | 5/2021 | Tiramani | E04B 1/3441 | |
| 11,009,109 | B2 * | 5/2021 | Martyn | E04B 1/3441 | |
| 11,136,771 | B2 * | 10/2021 | Petty | E04B 1/34357 | |
| 2003/0213185 | A1 * | 11/2003 | Findley | E04B 1/3431 | 52/64 |
| 2007/0196194 | A1 * | 8/2007 | Clement | E02B 3/064 | 410/52 |
| 2014/0090312 | A1 * | 4/2014 | Medley | E04B 1/3444 | 52/79.5 |
| 2017/0350144 | A1 * | 12/2017 | Tann | E04G 1/152 | |
| 2018/0258658 | A1 * | 9/2018 | Cruz | E04H 1/1205 | |
| 2019/0136605 | A1 * | 5/2019 | Ferrer Garcia | E04B 1/34357 | |

FOREIGN PATENT DOCUMENTS

| | | | | |
|---|---|---|---|---|
| EP | 2649249 | B1 | 9/2008 | |
| EP | 3124371 | A1 * | 2/2017 | B63B 29/02 |
| EP | 2649249 | B1 * | 3/2017 | E04B 1/003 |
| FR | 2633651 | A1 * | 1/1990 | E04D 13/0358 |
| WO | 2012076530 | A1 | 6/2012 | |

OTHER PUBLICATIONS

Search Report for German Application No. 10 2018 129 776.9 dated Nov. 23, 2019.

* cited by examiner

BALCONY SYSTEM WITH COUNTERFORCE UNIT

CROSS REFERENCE TO RELATED APPLICATION

The present application is a National Stage of International Application No. PCT/EP2019/082594, filed Nov. 26, 2019, which claims priority to and benefit of German patent application DE 10 2018 129 776.9 filed Nov. 26, 2018, both of which are fully incorporated by reference and made a part hereto.

FIELD

Embodiments of the present invention relate to a balcony system, more particularly to a balcony system having a counterforce unit, such as a counterweight unit. Further, some embodiments relate to a temporary balcony system, wherein the balcony system additionally provides the functionality of a piece of furniture. Further embodiments relate to the use of such balcony systems as temporary balconies for building openings, for example for windows, and to methods for setting up a temporary balcony.

BACKGROUND

Many buildings and apartments, especially apartments in older buildings, do not have their own outdoor balconies. In principle, however, there is a demand for outdoor balcony space, as this increases the quality of housing and the quality of life.

Temporary balconies are known to provide apartments without conventional balconies with an outdoor balcony area. From EP 2 649 249 B1 a balcony system is known which is suitable for use with a building opening of a building structure, such as a window. This balcony system comprises a balcony unit adapted to project out of the building opening, a counterforce unit adapted to compensate forces acting on the balcony unit without interfering with the building structure, and a connecting element connecting the balcony unit and the counterforce unit.

FIGS. 14-17 show a mobile balcony system 100' known from EP 2 649 249 B1, which is located in a building structure 1, e.g. the room of an apartment. The balcony system 100' stands on the floor of the building structure. In FIG. 14, the balcony system 100' is compactified. In particular, the balcony unit 110' of the balcony system 100' is dismountable, wherein in FIG. 14 the floor 112' is located on top of the counterforce unit 120' and is connected thereto by a connecting element 130' in the form of a rail system 132'. A parapet 114' is located at least laterally and at the front of the counterforce unit 120'. In the compactified state, the balcony system is, for example, a piece of furniture in the form of a sideboard. The balcony system 100' includes a mobility system 150' that includes eight rollers 155', only four of which are visible due to the side view. The rollers 155' allow the balcony system 100' to be moved in front of a building opening 10, as shown in FIG. 15. Here, a window sash 12 is shown open, which had previously closed the building opening 10 that has the form of a window. The parapet 114' is vertically movable, illustrated by a vertical double arrow in FIG. 16. The parapet 114' is further adapted to detachably connect to the floor 112'. This creates a balcony unit 110' prepared for use as a balcony. The balcony unit 110' is horizontally movable relative to the counterforce unit 120' by the rail system 132', which is illustrated by a horizontal double arrow in FIG. 17. In FIG. 17, the balcony unit 110' is shown in its balcony state. Here, the balcony unit 110' is located above the counterforce unit and projects forward beyond it. In particular, the balcony unit 110' projects out from the window 10, forming an outdoor balcony.

A temporary balcony can be provided by this balcony system known from EP 2 649 249 B1. However, the setup may require strength and care from the user, especially when moving the mobile balcony system and positioning and aligning it in front of the window. It may be difficult for a single person to move the mobile balcony system around the room and find a stable, wobble-free stand for use as a temporary balcony, especially if the floor should additionally have a certain unevenness. Also, careless movement of the mobile balcony system could result in damage to the building wall from ramming Careless, slanted alignment could, for example, cause damage to the window by canting the balcony unit during assembly or disassembly. Also, moving the mobile balcony system could lead to increased wear of the floor. In addition, it is conceivable that the mobile balcony system could be pushed to places in the building structure that are not statically designed for this load, resulting in danger to life and limb. In addition, although this mobile balcony system can be transformed into a piece of furniture, the freedom of design with regard to the type, shape, weight and function of the piece of furniture is limited by its function as a mobile balcony system.

Therefore, there is an interest in creating an improved balcony system that can be cost-effectively retrofitted in buildings without conventional balconies, that is simple, safe and gentle on the building in terms of construction and use, and that may also allow design freedom for additional use as a piece of furniture.

SUMMARY

In light of the above, a balcony system, the use of such a balcony system, and a method for setting up a temporary balcony according to the independent claims are provided. Further advantageous embodiments, which may be suitably combined with each other in any desired manner, can be found in the dependent claims, the drawings and the description.

According to one embodiment, a balcony system is provided for use with a building opening of a building structure, such as a window. The balcony system includes a balcony unit adapted to protrude from the building opening, a counterforce unit adapted to compensate for forces applied to the balcony unit, and a first connecting element connecting the balcony unit and the counterforce unit. The counterforce unit includes a base unit, a top unit on the base unit, and a second connecting element. The base unit is adapted for stationary installation with respect to the building structure, such as for stationary installation on a floor of the building structure. The first connecting element connects the balcony unit and the top unit. The second connecting element connects the top unit and the base unit. The top unit is movable relative to the base unit. For this purpose, the second connecting element can include, for example, a rail on the underside of the top unit.

Another embodiment includes using a balcony system described herein as a temporary balcony for a building opening, such as a window.

According to another embodiment, a method for setting up a temporary balcony is provided. The method includes setting up a balcony system described herein in a building structure having a building opening, wherein setting up the balcony system includes setting up the base unit of the balcony system stationary with respect to the building structure. The method further includes moving the top unit relative to the base unit so that the balcony unit connected to the top unit is moved in front of the building opening, and moving the balcony unit relative to the top unit so that the balcony unit projects out of the building opening.

BRIEF DESCRIPTION OF THE DRAWINGS

The above and other detailed aspects are elaborated in the description and explained at least in part with reference to the figures. Therein, the figures show the following.

DETAILED DESCRIPTION

Figure 1:
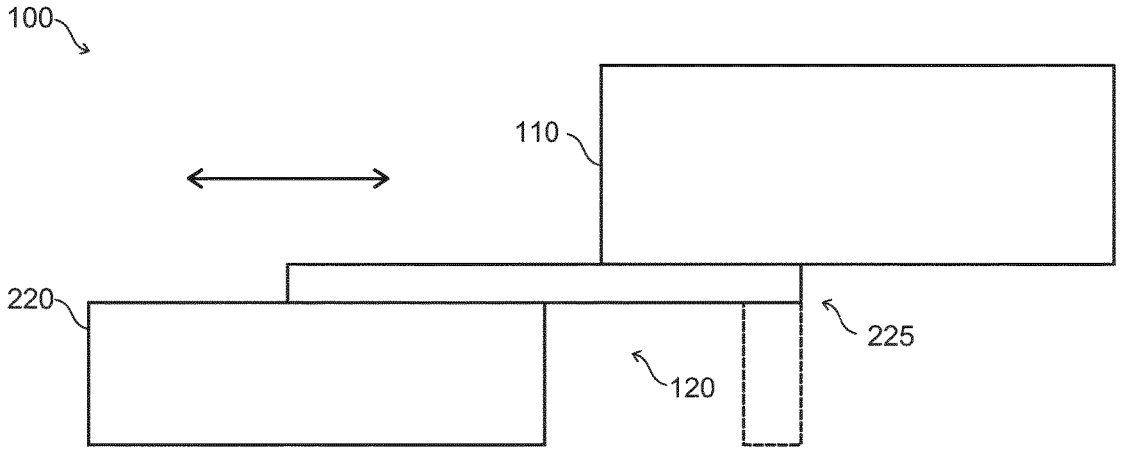
FIG. 1 shows a side view of a balcony system according to embodiments described herein.

Within descriptions of the figures, identical reference signs refer to identical or comparable components. In general, only the differences between individual embodiments are described. The figures are not necessarily true to scale and are for illustrative purposes.

The term "statically closed system", or equivalently "statically self-contained system", used herein means that such a system is capable of free standing, i.e., requires only the floor on which it stands to compensate for at least its own weight forces. A statically closed balcony system is typically capable of compensating not only its own weight forces without tipping, but additionally the weight forces of a load (up to a given maximum load) and, if necessary, also laterally acting forces. The term "statically closed system" does not exclude the possibility that such a system, although in principle capable of free standing, may nevertheless transfer forces to the building structure at points other than its standing surface, e.g. by means of pressing devices as described in EP 2 649 249 B1. The contents of EP 2 649 249 B1 are incorporated herein by reference in their entirety, at least to the extent that they do not conflict with features of the embodiments described herein. Thus, the statically closed system need not necessarily be free-standing, but must have the capability to be so.

The term "building structure non-intrusive" (free of intrusion into the building structure) as used herein means that a corresponding building structure non-intrusive system is intended and configured to be connected to a building structure in a manner that does not interfere with the building structure. In particular, building structure interference is present when the system includes screws, bolts, nails, anchors, or similar fasteners that penetrate or are intended to penetrate the building structure to connect the system to the building structure. Permanent connection to the building structure, e.g., by welding or gluing in place or similar means, also constitutes an intrusion into the building structure, and a system permanently connected to the building structure is not considered to be building structure non-intrusive. On the other hand, pressing devices, e.g., punches, that merely press against the building structure, e.g., laterally against the building opening, and are released after use, are not considered to interfere with the building structure.

A system is "essentially building structure non-intrusive" (essentially free of intrusion into the building structure) if it interferes with the building structure with at most one or more statically insignificant parts. The one or more parts are structurally insignificant if it/they cannot support the dead weight of the system alone or in combination, and in the case of a balcony system, if applicable, not the dead weight and a specified maximum load that may result from safety regulations. For example, a structurally closed balcony system in the sense explained above that is in principle free-standing but to which a structurally insignificant bolting or anchoring to the building structure is added is still considered to be essentially building structure non-intrusive.

According to embodiments described herein, a balcony system is provided. The balcony system is adapted for use with a building opening of a building structure. The building opening may typically be a window. Windows, at least in living spaces, have a minimum distance (parapet height/sill height) from the floor, typically greater than 80 cm, for safety reasons. However, apartments in older buildings sometimes have a spacing of only 60 cm. A balcony system for use with a window of a building structure has a corresponding suitability if it takes this spacing into account, e.g. at least 60 cm or at least 80 cm.

The balcony system may be a structurally closed system. According to some embodiments, the balcony system is substantially building structure non-invasive or even building structure non-invasive. According to further embodiments, the balcony system is statically closed and substantially building structure non-invasive. According to some embodiments, the balcony system is a temporary balcony system that is structurally closed, and/or building structure non-invasive. The balcony system may be freestanding. A freestanding balcony system transfers essentially no forces to the building structure outside its footprint. Essentially no transfer of forces takes place if it has no supporting function. A free-standing balcony system can, for example, touchingly contact parts of the building structure other than its footprint, e.g. the wall in front of a window or the window sill, without activating them statically.

The balcony system includes a balcony unit. The balcony unit is configured to project out of the building opening. Typically, the balcony unit is configured to project temporarily out of the building opening. Thereby, the balcony unit may be movable relative to other components of the balcony system, in particular relative to a counterforce unit, whereby the balcony unit may be movable out through the building opening and back in. The balcony unit, together with a top unit of the counterforce unit described herein, may be movable toward and away from the building opening, while a base unit of the counterforce unit described herein remains stationary with respect to the building structure at a distance from the building opening. The balcony unit may be movable relative to the top unit. In particular, the balcony unit can be moved relative to the top unit when the top unit has reached its extended end position in which the front end of the top unit has approached the building opening. The balcony unit can be moved out of the building opening by the relative movement to the top unit.

The balcony unit forms the balcony of the balcony system in the state in which it protrudes from the building opening. In the following, this is described by the term "the balcony unit in its balcony state". In contrast to this state, the balcony unit may be, for example, in a retracted state, in which it may even be disassembled into parts (such as the floor, parapet/railing or even railing sections). The balcony system is in the balcony state when the top unit is moved towards the building opening and the balcony unit projects out of the building opening. The balcony system is in a compactified state when both the balcony unit and the top unit are retracted. The balcony system is in the state of assembly when the top unit is moved towards the building opening, but the balcony unit is not (yet) pushed out through the building opening.

The direction in which the balcony unit is movable relative to the counterforce unit, or in which the top unit is movable relative to the base unit, is referred to as the longitudinal direction, and dimensions in this direction are referred to as lengths. Here, "forward" is said to be the direction in which the top unit and the balcony unit are extended to set up the balcony, and correspondingly, "rearward" is said to be the direction in which the top unit and the balcony unit are retracted to compactify the balcony system. The terms "front"/"rear" or "front area"/"rear area" etc. should be understood accordingly. The transverse direction, or lateral or side direction, is perpendicular to the longitudinal direction and, like the longitudinal direction, extends in a horizontal plane. Left and right are to be understood when viewing forward in the longitudinal direction. Dimensions in the lateral direction are referred to as widths. The vertical direction is perpendicular thereto, and dimensions in the vertical direction are referred to as heights. With respect to the vertical direction, the terms top, bottom, etc. are used.

The balcony system includes a counterforce unit. The counterforce unit is designed to compensate for forces acting on the balcony unit. Such forces can be, in particular, weight forces, e.g. the weight forces of the balcony unit and possibly other loads, for example persons. However, lateral forces can also occur and be compensated, e.g. forces that arise when persons act on a parapet of the balcony unit or when wind acts on the balcony unit (wind loads). Compensation of forces acting on the balcony unit means compensation up to specified maximum forces. These maximum forces can be specified, for example, by DIN standard 1055. DIN standard 1055 is incorporated herein by reference in its entirety. Typically, the specified maximum forces include a specified maximum load similar to that for conventional balconies that are connected to the building structure. In addition, predefined laterally acting maximum forces may also be specified, which need compensation for safety reasons. Compensation of forces is herein understood to also mean compensation of torques associated with these forces.

The balcony system includes a first connecting element that connects the balcony unit and the counterforce unit. Forces acting on the balcony unit can be transmitted to the counterforce unit through the first connecting element. The counterforce unit can be set up to compensate for a large part of the forces acting on the balcony unit, typically even all of the forces acting on the balcony unit, without interfering with the building structure. In this case, the weight force of the counterforce unit can lead to compensation of the forces acting on the balcony unit. Alternatively or additionally, the forces acting on the balcony unit may be compensated in whole or in part by other forces exerted by components of the counterforce unit. These could be, for example, pressing devices of a top unit of the counterforce unit. The counterforce unit is different from the building structure. The counterforce unit is also different from elements which are firmly connected to the building structure or which interfere with the building structure and are statically essential for the balcony system, e.g. a wall anchorage, but also a heating element. This does not exclude that the balcony system could additionally have such systems interfering with the building structure, especially if they are statically insignificant. These could be, for example, safety devices for exceptional cases to stop the balcony from tilting even if the maximum loads are exceeded.

According to some embodiments, the balcony system can provide a balcony without requiring structural modifications to the building. Typically, the balcony system is usable without the need to make structural connections to the building structure or to parts connected or attached to the building structure. This makes the balcony system usable for most average homes. At the same time, expensive remodeling costs are often saved. In particular, if the balcony system is structurally self-contained, safe use can be made possible. Due to the counterforce unit connected to the balcony unit, the balcony can be safe for use regardless of any assistance by a user.

The counterforce unit includes a base unit and a top unit. The base unit is designed for a stationary installation with respect to the building structure. The base unit can typically be arranged for a stationary installation on a floor of the building structure. Due to a stationary installation, the base unit can be immobile as intended. The base unit may therefore be referred to as immobile. If the balcony system is statically self-contained and there is also no statically insubstantial structural connection to the building structure, the balcony system as a whole and thus the base unit could potentially be moved by large forces that may exceed that of a human, similar to a heavy bed or wardrobe, which would also be described as immobile and stationary in the same sense.

The base unit may have a standing surface (footprint). The standing surface may be on the underside of the base unit, i.e. on the side facing the floor of the building structure, and may consist of several individual surfaces or be continuous. The standing surface can transfer at least part of the load of the balcony system and any loads thereon, such as persons, to the floor of the building structure, thereby statically activating this floor. The standing surface can be roughened or rubberized to prevent or at least make it more difficult for the base unit to shift.

The base unit may have a height greater than the height of a portion of the top unit seated on the base unit. The height of the base unit and the height of the portion of the top unit seated on the base unit may together constitute the height of the counterforce unit. The counterforce unit may have a height at least equal to the height of the parapet of the building opening, for example at least 60 cm or at least 90 cm high. The height of the base unit may be more than 60%, more than 70%, more than 80% or even more than 90% of the total height of the counterforce unit. Thus, the height of the base unit may substantially equal the parapet height of the building opening.

The top unit is movable relative to the base unit. The top unit can be seated on the base unit. The top unit may include a seated portion that seats on the base unit. The seated portion may be substantially cuboidal in shape. The seated portion may be plate-shaped. The seated portion may include a support element configured for force transmission to the building structure. In particular, the support element may be arranged for a force transmission before, during and after a relative movement between the top unit and the base unit that is stationary with respect to the building structure. The support element may have a height such that the lowest point of the support element contacts the floor of the building structure when the top unit is seated on the base unit. The height of the support element may be equal to the height of the base unit. The support element may be located at the bottom of the seated portion of the top unit that seats on the base unit. The support element may be attached as a separate part to the underside of the seated part, whereby the attachment may be detachable or permanent, e.g. screwed or riveted.

The support element may include a roller unit. A roller unit in the sense used herein may have one roller whose axis is supported in a body of the roller unit, or may have several, in particular two, rollers whose axes are supported parallel to each other in the body of the roller unit. The body of a roller unit may be made of metal. In particular, a roller unit may be a separate component that can be connected to other components, for example by screws or other forms of mounting. The roller unit may have one or more axes oriented in the transverse direction of the balcony system, wherein one, two, or more than two rollers may be disposed on each of the one or more axes. The support element may include two or more roller units of the type described, the axes of which may be oriented in the transverse direction of the balcony system. The support element may include a roller system with a number of 2, 3, 4 or more roller units. Roller units of the support element may be arranged at the bottom side of a body of the support element. The body may be cuboid-shaped, for example. The support element may be arranged such that the roller or the rollers of the one or more roller units roll(s) over the floor of the building structure or over a floor plate of a structural module of the base unit when the top unit is moved relative to the base unit. Alternatively, the support element may be adapted to slide over the floor of the building structure or over a floor plate of a structural module of the base unit when the top unit is moved relative to the base unit. For this purpose, the underside of the body of the support element may be made of a material capable of sliding, such as felt or other pressure-resistant textiles.

The top unit can be designed as a clamped beam for linear movement relative to the base unit, i.e. as a beam which retains one direction of movement while otherwise being a clamped beam. If the top unit is extended and locked in the assembled state, the top unit can be a clamped beam in this state, i.e. a beam that is left with no degree of freedom of movement. In particular, the part of the top unit resting on the base unit may be designed as a linearly movable clamped beam. The top unit, or the part of the top unit sitting on the base unit, can be designed as a linearly movable clamped, supported beam. The support can be provided exclusively by the support element. Alternatively, support of the top unit formed as a clamped beam could be effected partly or exclusively by a structural module of the base unit described below or even by the lower side of the building opening, e.g. a ledge or window sill of the building opening. In the latter case, the wall with the building opening would be statically activated and the balcony system would not be statically self-contained.

The counterforce unit includes a second connecting element. The second connecting element connects the top unit and the base unit. The second connecting element may connect the top unit and the base unit in a second connecting region. The second connecting element may include a first rail on a bottom surface of the top unit. The first rail of the second connecting element may be disposed along the longitudinal direction of the balcony system. The first rail may enable, or serve to enable, movement of the base unit and the top unit relative to each other. The second connecting element may include a second rail system. The second rail system may include the first rail. The second rail system may include a second rail on the underside of the top unit. The first rail and the second rail of the second rail system may be oriented along the longitudinal direction of the balcony system, that is, may be parallel to each other, and may be spaced apart from each other in the transverse direction. The second connecting element may connect the top unit and the base unit in the second connecting region through the second rail system.

The second connecting element, or the second rail system, may include two roller units spaced apart from each other in the longitudinal direction of the balcony system. A roller unit may include one roller, the axis of which is supported in a body of the roller unit, or may include several, in particular two, rollers, the axes of which are supported parallel to each other in the body of the roller unit. These axis/axes may in particular be horizontal. A roller unit, in particular if it is designed to run in a rail, may also have one or possibly more rollers whose axis is vertical. Such a roller with a vertical axis can ensure, in operation, lateral clearance from walls of a rail that has a hollow profile. The two roller units may be mounted on the top of the base unit. The rollers of the two roller units of the second connecting element, spaced in the longitudinal direction of the balcony system, may engage the first rail of the second connecting element, or the second rail system. Said rollers may run in the first rail. Said first rail may enclose said rollers so that said rollers are confined to running in said first rail. The first rail may have a corresponding hollow profile. Hereby, the top unit can be designed as a linearly movable clamped beam with respect to the base unit. Running points of the rollers of the two roller units furthest apart in the longitudinal direction can define the second connecting region.

The second connecting element, or the second rail system, may include further two roller units cooperating with the second rail of the second rail system. The further two roller units may be spaced apart from each other in the longitudinal direction of the balcony system, preferably at the same distance as the first-mentioned two roller units, and may be spaced apart from the first-mentioned roller units in the transverse direction of the balcony system. The further two roller units may be mounted on the top of the base unit. The rollers of the further two roller units of the second connecting element may engage with the second rail of the second connecting element, or the second rail system. The rollers may run in the second rail. The second rail may enclose the rollers of the further two roller units so that these rollers are confined to running in the second rail. The second rail may have a corresponding hollow profile. Through this, the top unit can be designed as a linearly movable clamped support in relation to the base unit. The second connecting element can include further rails and roller units of the type described.

As an alternative to a second connecting element, or second rail system with rails and roller units as counterparts, the second connecting element or rail system could also consist exclusively of rails, with corresponding rails and complementary rails of the second connecting element sliding into each other. For example, the first rail of the second rail system may enclose or be enclosed by a first complementary rail, the first complementary rail being mounted on the top surface of the base unit. The first complementary rail may be shorter than the first rail and may define the second connecting region. Similarly, a second complementary rail may be provided for the second rail of the second rail system. To improve sliding of the rails and complementary rails relative to each other, the rails and/or complementary rails may be made of a low friction material or may be coated with such a low friction material on the surfaces sliding relative to each other.

The stationary installation of the base unit with respect to the building structure means that in the event of a relative movement of the top unit and base unit, the top unit moves relative to the building structure, while the base unit remains stationary and unmoved. In particular, the relative movement of the top unit and base unit can serve to move the front end of the top unit, as seen in the longitudinal direction of the balcony system, toward the building opening. A distance that the balcony system may have to the building opening in a compactified state can thus be overcome. The length of the top unit can be dimensioned accordingly to be able to bridge a distance to the building opening. In this regard, the length of the top unit may be substantially equal to the length of the second connecting region plus the length of the cantilevered portion of the top unit in the extended state, wherein the length of the cantilevered portion may correspond to the distance to the building opening. The second connecting element may be arranged to allow relative movement of the top unit and the base unit to bring the balcony system into its assembled state and/or to bring them out of this assembled state into the compactified state. The top unit may be cantilevered with respect to the base unit at least temporarily, namely in the assembled state and/or balcony state of the balcony system. The top unit may thus be configured to form a cantilever. The base unit can be fixedly connected to the top unit via the second connecting element.

The freedom of movement of the top unit in the longitudinal direction relative to the base unit may be limited. The top unit, or the part of the top unit resting on the base unit, may have a rear end opposite to a front end, the front end being the end located at that part of the top unit which may project beyond the base unit. The first rail of the second connecting element may include a first stop element. The first stop element may be located at the rear end of the top unit. The first stop element prevents the top unit from moving longitudinally forward when the first stop element cooperates with a first complementary stop element attached to the base unit. The first stop element may be a closed rear end of the first rail. The first complementary stop element may be the rearmost roller of the rearward roller unit of the two longitudinally spaced roller units of the second connecting element. Alternatively, the first complementary stop element may be a rear end of a first complementary rail. The first rail of the second connecting element may have a second stop element. The second stop element may be located at the front end of the top unit. The second stop element prevents the top unit from moving longitudinally rearward by the second stop element cooperating with a second complementary stop element attached to the base unit. The second stop element may be a closed front end of the first rail. The second complementary stop element may be the foremost roller of the forward roller unit of the two longitudinally spaced roller units of the second connecting element. Alternatively, the second complementary stop element may be a front end of a first complementary rail. The same may apply to the second rail of the second connecting element in interaction with the further two longitudinally spaced rollers, or alternatively in interaction with a second complementary rail. Additionally or alternatively, the second stop element may be formed by the rear side of the support element and the complementary second stop element may be formed by the front side of the base unit. During retraction, the rear side of the support element and the front side of the base unit may abut each other and prevent further movement. Also additionally or alternatively, the first stop element may be formed by the front side of the support element. The wall with the building opening can serve as a complementary stop element that prevents the top unit from moving further forward. The freedom of movement of the top unit in the longitudinal direction relative to the base unit can correspond to the length of the cantilevered part of the top unit, minus the length of the support element where appropriate.

The counterforce unit may include a counterweight for compensating at least a major part of the forces acting on the balcony unit. In particular, the counterforce unit may include a counterweight arranged to compensate for all forces acting on the balcony unit. The weight force of other parts of the counterforce unit, and possibly also other devices, e.g. pressing devices, can also lead to a partial compensation of said forces. However, a counterweight that is set up to compensate all forces acting on the balcony unit is dimensioned and, if necessary, placed in such a way that it could already compensate the forces acting on the balcony unit up to predetermined maxima on its own. E.g. the counterweight is dimensioned in such a way that the balcony unit in its balcony state satisfies national safety regulations regarding statics on the basis of the counterweight alone, without relying on other compensation mechanisms. A counterforce unit that includes a counterweight is referred to herein as a counterweight unit.

Balcony systems according to embodiments described herein may include a counterweight unit, i.e., a counterforce unit that includes a counterweight. The counterweight may be arranged to compensate for at least a majority of the forces acting on the balcony unit, typically to compensate for all forces acting on the balcony unit.

The counterweight can be arranged in the top unit. The counterweight can be arranged above the base unit. The counterweight can be accommodated in the part of the top unit that sits on the base unit. The counterweight may be arranged in a rear portion of the top unit with respect to the longitudinal direction of the balcony system, for example adjacent to the rear end of the top unit. The counterweight can be located above the base unit in any state of the balcony system and can statically activate the base unit, or only a statically active module of the base unit, via the second connecting element.

The mass of the counterweight can be dimensioned in such a way that the weight force of the counterweight can compensate for all forces acting vertically on the balcony unit up to a predetermined maximum load, i.e. in particular the dead weight of the balcony unit plus the weight force of persons or objects located on it. More precisely, the mass and position of the counterweight as well as the support point/pivot point of the balcony system (e.g. via the end position of the support element at the building opening) can be selected in such a way that corresponding torques can be compensated. The mass of the counterweight may be, for example, between 100 and 400 kg, typically between 150 and 300 kg, e.g., about 200 or about 250 kg. The counterweight may include, for example, concrete, metal, such as iron, steel, or lead, water in a suitable tank, a fill material such as sand in a suitable container, or combinations thereof. The counterweight may be composed of partial weights, such as individual concrete slabs. The partial weights may be sized to be carried by one person. For example, the partial weights may be no more than 50 kg, typically no more than 40, 30 or even 20 kg. Forces acting laterally on the balcony unit, e.g. due to the action of persons on the parapet or due to wind loads, can be transmitted to the base unit via the second connecting region, if necessary. The mass of the counterweight and the mass of the base unit, or the mass distribution of these components, can be selected in such a way that all forces or corresponding torques can be compensated up to predefined maximum loads.

The base unit can be of modular design. The base unit can include a basic module. The basic module is set up for interaction with the top unit via the second connecting element. The basic module may support the components of the second connecting element on the base unit side. In particular, the longitudinally spaced roller units may be mounted on the basic module. The basic module may include two transversely extending elements longitudinally spaced from each other by a distance equal to the longitudinal spacing of the roller units. The transversely extending elements may have the roller units of the second connecting element mounted thereon. The basic module may have one or more elements extending in the longitudinal direction connecting the elements extending in the transverse direction. Thus, the basic module may provide a stiffened frame structure that provides a platform for the top unit. The basic module may have, for example, the shape of an elongated H when viewed from above, i.e. looking downwards, with the connecting web corresponding to the element running in the longitudinal direction and the two parallel stretches corresponding to the elements running in the transverse direction. The basic module can be set up to absorb all the forces transmitted via the top unit and acting on the balcony system, with the exception of the forces led off via the support element, in particular weight forces of the counterweight, and to transmit them to the floor of the building structure. The basic module can be set up for stationary installation with respect to the building structure, in particular for installation on the floor of the building structure or on a structural module of the base unit.

The base unit can have one or more add-on modules. Add-on modules may be arranged to provide furniture functionality. For example, an add-on module may be a shelf, a chest of drawers, a cabinet, a bed, or a part of the aforementioned furniture items. Add-on modules may be attached to the basic module or inserted into spacings within the basic module. The basic module, the top unit, and/or the balcony unit may contribute to the furniture functionality of the one or more add-on modules, particularly when the balcony system is compactified. The one or more add-on modules can make the base unit, or the balcony system, one or more pieces of furniture, optionally in cooperation with the basic module, the top unit, and/or the balcony unit. The add-on modules may be immaterial to the functionality of the balcony system, which is to provide a balcony, and/or to the structural design of the balcony system. In other words, the add-on modules can be freely chosen to provide any desired furniture functionality/functionalities without having to comply with specific safety requirements that would have to be attached to the provision of a (temporary) balcony. The one or more add-on modules can be set up for a stationary installation with respect to the building structure, in particular on the floor of the building structure or on a structural module of the base unit.

The base unit can include a structural module. The structural module may be arranged to distribute forces exerted by the balcony system over a floor area of the building structure and/or to compensate for floor unevenness of the building structure. The structural module may include a floor plate. The floor plate may be a load distributing plate for distributing forces exerted by the balcony system over a floor area. The floor plate may be arranged so that the support element of the top unit can roll or slide over it. In the longitudinal direction of the balcony system, the floor plate may extend at least between a front end of the basic module and the building opening, but may also extend below the basic module and/or the add-on module(s). In a transverse direction, the base plate may have at least the width of the support element. The floor plate may be arranged for at least one of the following: distributing forces exerted by the balcony system over a floor area of the building structure, compensating for a floor slope, compensating for floor unevenness, reducing a rolling or sliding resistance of the support element compared to rolling or sliding over the floor surface. The structural module may include beams and/or pedestals disposed below the floor plate. Beams may be particularly arranged for distributing forces exerted by the balcony system over the floor area of the building structure. Pedestals may in particular be set up for compensating for a floor slope and/or compensating for floor unevenness. The structural module could also include a touchdown element for the top unit, particularly if the top unit does not have a support element. The touchdown element may be located at the building opening, for example, and may extend vertically, with the height of the touchdown element being such that the top unit, when it is extended, rests on, and can be supported by, the touchdown element. The touchdown element could consist of posts or a plate that is/are connected to the base plate.

The first connecting element connecting the balcony unit and the counterforce unit can transmit the forces acting on the balcony unit to the counterforce unit, which can typically compensate for at least most or even all of these forces. The first connecting element connecting the counterforce unit and the balcony unit connects the balcony unit and the top unit of the counterforce unit. The first connecting element may connect the balcony unit and the top unit in a first connecting region, such as in a portion of a first rail system.

Alternatively, the balcony unit and the counterforce unit may be connected in one or more connection points between the balcony unit and the top unit, typically in one or more joints. Joints may be arranged in a line, e.g. an upper front edge of the top unit, or may themselves be a linear joint. The first connecting element may also include a tension structure and/or a compression structure, e.g. a tension bar, compression bar or tension-compression bar, in particular in the case of a connection through one or more joints. The tension structure and/or compression structure can transmit forces acting on the balcony unit to the top unit of the counterforce unit.

The first connecting element may include a first rail on the underside of the balcony unit. The first rail of the first connecting element may be arranged along the longitudinal direction of the balcony system. The first rail of the first connecting element may enable, or serve to enable, mobility of the balcony unit and the top unit relative to each other. The first connecting element may include a first rail system. The first rail system may include the first rail of the first connecting element. The first rail system may include a second rail on the underside of the balcony unit. The first rail and the second rail of the first rail system may be arranged parallel to each other along the longitudinal direction of the balcony system, and spaced apart from each other in the transverse direction. The first connecting element may connect the balcony unit and the top unit in the first connecting region through the first rail system.

The first connecting element, or the first rail system, may include two roller units spaced apart from each other in the longitudinal direction of the balcony system. A roller unit may, as previously described, include a roller whose axis is mounted in a body of the roller unit, or may include several, in particular two, rollers whose axes are mounted parallel to each other in the body of the roller unit. These axis/axes may in particular be horizontal. A roller unit, in particular if it is designed to run in a rail, may also have one or possibly more rollers whose axis is vertical. In operation, such a roller with a vertical axis can ensure lateral clearance from walls of a rail with a hollow profile. The two roller units may be mounted on the top of the top unit. The rollers of the two roller units of the first connecting element, spaced apart in the longitudinal direction of the balcony system, can engage the first rail of the first connecting element, or the first rail system. The rollers may run in the first rail of the first rail system. This first rail may enclose the rollers such that the rollers are confined to running in the first rail of the first rail system. The first rail of the first rail system may have a corresponding hollow profile. This allows the balcony unit to be configured as a linearly movable clamped beam in relation to the top unit. Running points of the rollers of the two roller units of the first rail system that are furthest apart in the longitudinal direction can define the first connecting region.

The first connecting element, or the first rail system may include further two roller units cooperating with the second rail of the first rail system. The further two roller units may be spaced from each other in the longitudinal direction of the balcony system, preferably at the same distance as the first-mentioned two roller units of the first rail system, and may be spaced from the first-mentioned roller units in the transverse direction of the balcony system. The further two roller units may be mounted on the upper side of the top unit. The rollers of the further two roller units of the first connecting element may engage in the second rail of the first connecting element, or the first rail system. The rollers may run in the second rail of the first rail system. The second rail of the first rail system may engage the rollers of the further two roller units, such that these rollers are confined to running in the second rail. The second rail of the first rail system may have a corresponding hollow profile. Through this, the balcony unit can be configured as a linearly movable clamped beam in relation to the top unit. The first connecting element can include further rails and roller units of the type described.

As an alternative to a first connecting element, or first rail system, with rails and roller units as counterparts, the first rail system could also consist exclusively of rails, with corresponding rails and complementary rails of the first connecting element sliding into each other. For example, the first rail of the first rail system may enclose or be enclosed by a first complementary rail, the first complementary rail being mounted on the top of the top unit. The first complementary rail may be shorter than the first rail and may define the first connecting region. Similarly, a second complementary rail may be provided for the second rail of the first rail system. To improve sliding of the rails and complementary rails relative to each other, the rails and/or complementary rails may be made of a low friction material or may be coated with such a low friction material on the surfaces that slide relative to each other.

In particular, the relative movement of the balcony unit and the top unit may serve to move the front end of the balcony unit, as seen in the longitudinal direction of the balcony system, out of the building opening. The length of the balcony unit may be substantially equal to the length of the first connecting element plus the length of the cantilevered portion of the balcony unit when extended. The first connecting element may be arranged to allow relative movement of the balcony unit and the counterforce unit to move the balcony unit into and/or out of its balcony state. The balcony unit may be cantilevered with respect to the counterforce unit at least temporarily, namely in the balcony state of the balcony unit. The balcony unit may thus be arranged to form a cantilever. The balcony unit can be fixedly connected to the top unit of the counterforce unit via the first connecting element.

The freedom of movement of the balcony unit in the longitudinal direction relative to the top unit may be limited. The balcony unit may have a rear end opposite to a front end. The first rail of the first connecting element may include a first stop element. The first stop element may be located at the rear end of the balcony unit. The first stop element prevents the balcony unit from moving longitudinally forward when the first stop element cooperates with a first complementary stop element attached to the top unit. The first stop element may be a closed rear end of the first rail of the first connecting element. The first complementary stop element may be the rearmost roller of the rearward roller unit of the two longitudinally spaced roller units of the first connecting element. Alternatively, the first complementary stop element may be a rear end of a first complementary rail of the first connecting element. The first rail of the first connecting element may include a second stop element. The second stop element may be located at the front end of the balcony unit. The second stop element prevents the balcony unit from moving longitudinally rearward by the second stop element cooperating with a second complementary stop element attached to the top unit. The second stop element may be a closed front end of the first rail of the first connecting element. The second complementary stop element may be the foremost roller of the forward roller unit of the two longitudinally spaced roller units of the first connecting element. Alternatively, the second complementary stop element may be a front end of a first complementary rail of the first connecting element. The same may apply to the second rail of the first connecting element in interaction with the further two longitudinally spaced rollers of the first connecting element, or alternatively in interaction with a second complementary rail of the first connecting element. The freedom of movement of the balcony unit in the longitudinal direction relative to the top unit may correspond to the length of the cantilevered portion of the balcony unit.

If, in particular with regard to components of the first connecting element and the second connecting element, such as rails or rollers (roller units), reference is made herein to a component being mounted on the base unit, the basic module, the top unit or the balcony unit, or being mounted on an underside or top side thereof, this also includes the possibility that the corresponding component may be fully or partially sunk in the unit or module in question, e.g. in recesses. For example, the first rail of the second connecting element could be sunk into the underside of the top unit so that this first rail is flush, i.e. does not protrude. The term mounting also includes situations in which these components are at least partially integrated into or integrally formed with the units or modules in question.

The balcony system is typically a temporary balcony system. In this case, a balcony can be set up by the balcony system when needed and removed when the need no longer exists. For example, a window may be temporarily converted to a balcony access when a balcony is temporarily established by the temporary balcony system, and then removed. This allows the window to be otherwise in ordinary use. This is especially true if the balcony system establishes a balcony without interfering with the building structure, and the balcony can subsequently be removed without leaving a trace. Due to the possibility of compactification, the balcony system takes up little space when it is not currently being used as a balcony. Parts of the base unit, especially add-on modules, can form a piece of furniture or several pieces of furniture, e.g. a bed, a wardrobe or a combination thereof.

The balcony unit may include a floor. The floor may serve as a support surface for loads, such as people, when the balcony unit extends out of the building opening to form a balcony. The balcony unit may include a restraining device, such as in the form of a parapet, railing, or guardrail. The restraining device is used to prevent people or objects from falling off the balcony unit in its balcony state. The restraining device may be fixedly connected to the floor or detachably connectable to the floor. The balcony unit may include a floor and a restraining device. The floor may be configured as a linearly movable clamped beam, or the restraining device may be designed as a beam. The floor can be cuboidal, in particular plate-shaped.

By moving the balcony unit, or parts of the balcony unit if it is demountable, relative to the counterforce unit/top unit, the balcony system can temporarily provide a balcony, namely when the balcony unit is in its balcony state, while at other times the balcony system can be compactified. The balcony unit may itself be compactifiable. The compactification of the balcony unit may complete the compactification of the balcony system. The balcony system may be arranged such that the balcony unit may be non-compactifiable in the assembly state and in the balcony state, but compactifiable only when the balcony unit and the top unit are retracted. To compactify the balcony unit, the restraining device may include individually retractable and extendable parts, in particular individually retractable and extendable railing sections, such as two side sections and a front section, and possibly two corner posts as well. The railing sections may be connected to the floor of the balcony unit by hinges and/or joints. The railing sections may be arranged to be collapsible inwardly onto the floor, while being movable outwardly when unfolded no further than to an orientation perpendicular to the floor. The railing sections may be adapted to detachably connect to each other when unfolded.

The balcony system described herein has a number of advantages over the previously known balcony system described above. Due to the stationary positioning of the base unit, the orientation of the balcony system, in particular its longitudinal direction, is fixed. At the same time, a suitable distance to the building opening is determined. Thus, unlike a completely mobile balcony system, careful handling, positioning and alignment by the user is not required, e.g. to ensure a stable, wobble-free installation or to avoid damage to the building wall or window. For example, ramming of the building wall and an inclined alignment of the balcony unit along with canting in the window are avoided. Also, with a stationary base unit, the entire weight of the balcony system does not have to be moved, which greatly facilitates assembly. At the same time, the mobility of the top unit relative to the base unit ensures that there is a distance from the building opening that is sufficient to ensure that access to the building opening is not permanently blocked and that the building opening can be used as intended, e.g. in the case of a window it can be opened and closed. The floor is also subjected to less wear in the balcony system according to embodiments than in the fully mobile balcony system, in particular if the counterweight is always located above the stationary base unit, whereas, for example, a support element rolling over the floor is generally subjected to much less load during the rolling process. In the case of a balcony system with a stationary base unit and a top unit that can be moved relative to it, the floor areas of the building structure that are statically loaded by the balcony system are fixed. It can be ensured that these floor areas are statically designed for this load, e.g. passively by testing or, if necessary, actively by using a structural module of the base unit. In this way, danger to life and limb can be ruled out.

Due to a modular design of the base unit, especially a basic module that stands in for the balcony functionality, the design freedom for an additional use of the balcony system as one or more pieces of furniture is increased. Add-on modules, which themselves do not have to provide anything for the balcony functionality and especially for the safety of the temporary balcony, can be designed almost arbitrarily to make the balcony system e.g. a bed, a wardrobe, a shelf, a chest of drawers or combinations thereof.

By means of a support element that can support the top unit at the building opening, the potential pivot point of the balcony system is favorably positioned to reduce the lever arm of the balcony unit in its extended state and to make it more difficult for the balcony system to tilt, or to increase the maximum permissible load at which this tilt would occur. By positioning the counterweight in the top unit, in particular at its rear end, and by appropriately dimensioning the mass of the counterweight, it can be brought about that the second connecting element need not be able to withstand essentially any tensile forces. The second connecting element, for example in the form of a second rail system with rails and rollers engaging therein, can then be designed to be simpler, less massive and less expensive. Any residual tensile forces acting on the second connecting element could be those that may arise when the balcony unit is loaded in the transverse direction, e.g. by wind load. The base unit can absorb such forces via the second connecting element and dissipate them to the floor and prevent the balcony system from tilting in the transverse direction. For this purpose, an increased extension of the basic module and/or of add-on modules in the transverse direction can be advantageous. The attachment of rails to the underside of the top unit and/or balcony unit means that these rails are protected from dirt and are also not visible. The counterparts of these rails, in particular rollers of roller units or complementary rails, can be confined to the connecting regions and are also not exposed during relative movements, so they are also protected from dirt and are not visible. Stop elements help to ensure that the balcony can be used safely and prevent damage to the building structure, e.g. by ramming.

FIG. 1 shows an embodiment of a balcony system 100. Shown is a lateral view of the balcony system 100. The lateral direction or transverse direction is perpendicular to the drawing plane. The area on the right in FIG. 1 is frontal or forward, and the area on the left is rear or rearward with respect to the longitudinal extension of the balcony system 100. The vertical direction is the up-down direction in FIG.

1. The balcony system includes a balcony unit 110, a counterforce unit 120, and a first connecting element 130 connecting the balcony unit 110 and the counterforce unit 120. The counterforce unit 120 includes a base unit 220, a top unit 225, and a second connecting element 230. The base unit 220 can be stationary with respect to a floor of a building structure. The second connecting element 230 connects the top unit 225 and the base unit 220. The top unit 225 is longitudinally movable relative to the base unit 220, as indicated by the double arrows. The top unit 225 and the balcony unit 110 are each shown in the forwardly extended state, i.e., the balcony system is in the balcony state.

Figure 2:
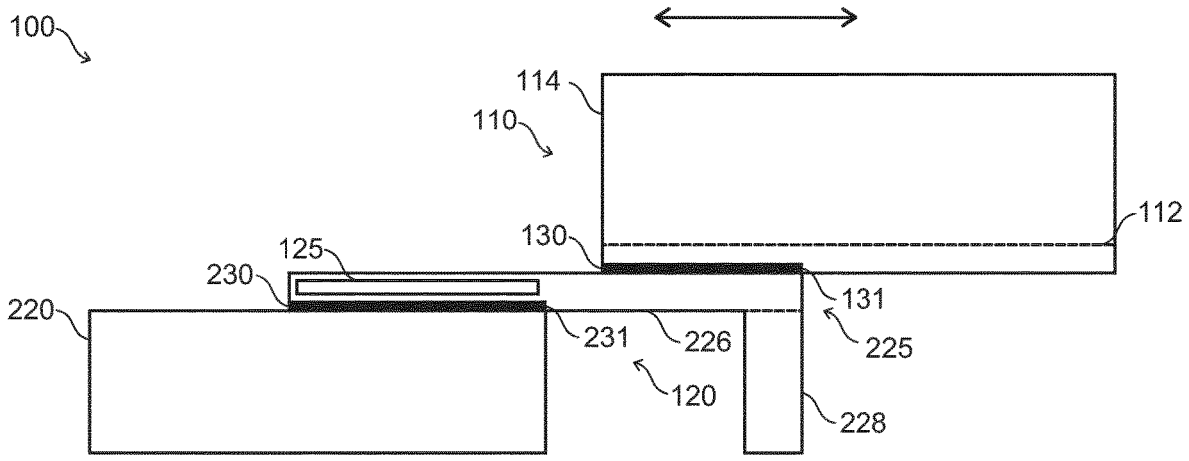
FIGS. 2-4 show side views of a balcony system according to embodiments described herein in various states of assembly or disassembly.

As shown in the embodiment of FIG. 2, the balcony unit 110 may be movable relative to the top unit 225, as indicated by the corresponding double arrows. The connecting element 130 may be formed as a connecting region 131. The balcony unit 110 may include a floor 112 and/or a restraining device 114 (parapet element, railing). The floor may be formed as a linearly movable clamped beam, which is linearly movable but otherwise clamped in the connecting region 131. The second connecting element 230 may be formed as a second connecting region 231. The top unit 225 may include a seated portion 226 seated on the base unit. The top unit 225, or the seated portion 226, may be formed as a linearly movable clamped beam that is linearly movable but otherwise clamped in the second connecting region 231. The top unit may include a support element 228. The support element 228 may support the seated portion 226, such that the top unit may be a linearly movable beam that is otherwise clamped in the second connecting region 231 and supported by the support element 228. The balcony system 110 may include a counterweight 125 disposed within the top unit 225, particularly a counterweight disposed at the rear end of the seated portion 226. A counterweight may be provided in any of the embodiments described herein, even if it is not shown in a figure. The balcony system is shown in the balcony state in FIG. 2.

Figure 3:
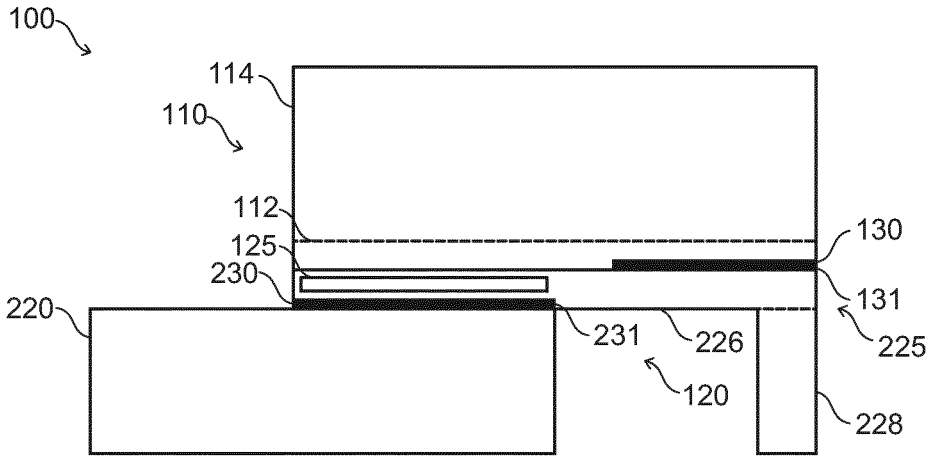
Figure 4:
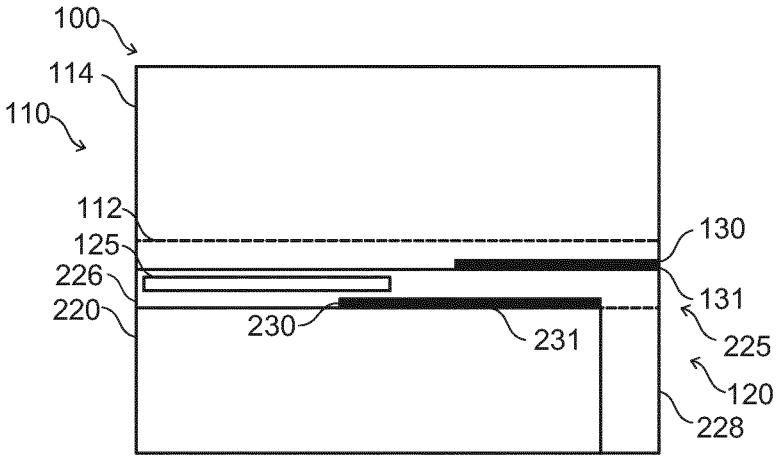

FIG. 3 shows the balcony system of FIG. 2 in the assembled state, in which the top unit 225 is shown in the forwardly offset, i.e. extended, state, while the balcony unit 110 is shown in the retracted state, in which the balcony unit 110 does not protrude longitudinally forward beyond the top unit 225. FIG. 4 shows the balcony system of FIG. 2 in the compactified state, in which both the top unit 225 and the balcony unit 110 are in the retracted state. In addition, the balcony unit 110 can be disassembled, for example, by detaching the restraining device 114 from the floor and placing it laterally next to the counterforce unit 120, or by folding the restraining device 114 in individual parts (cf. FIGS. 11-13).

Figure 5:
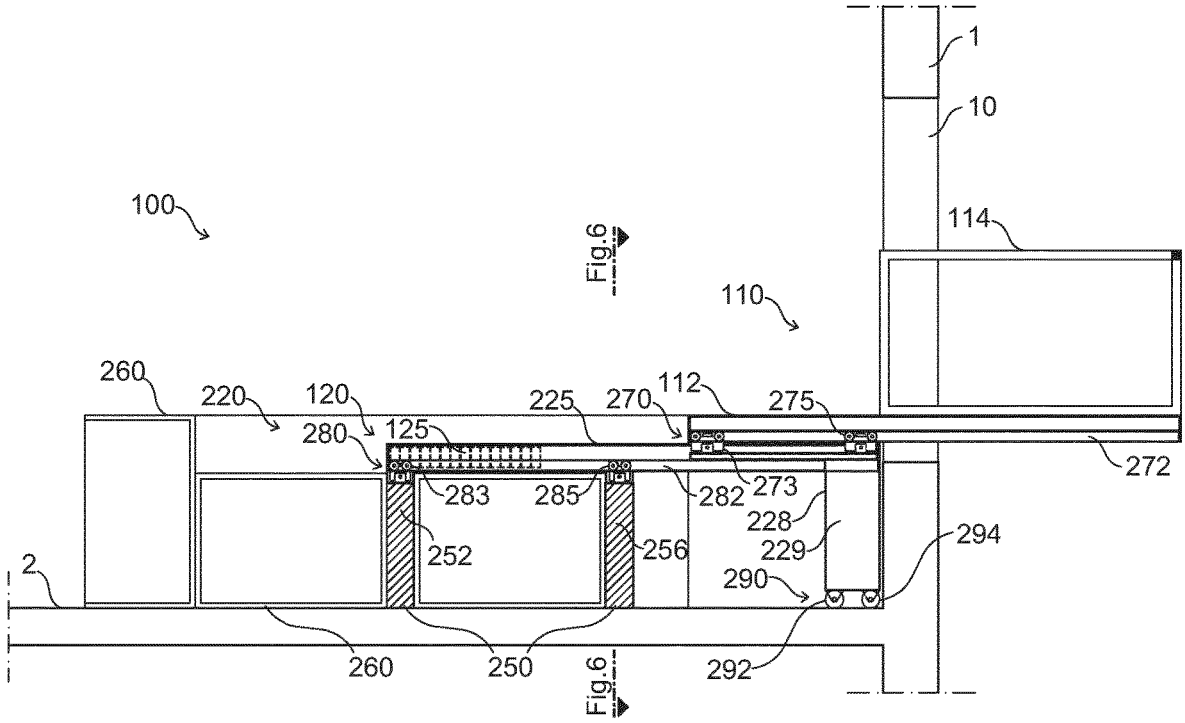
FIG. 5 shows a longitudinal sectional view of a balcony system according to embodiments described herein.
Figure 6:
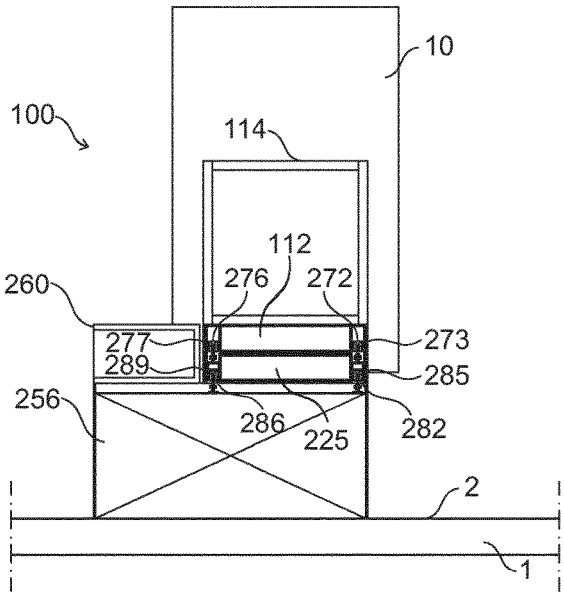
FIG. 6 shows a cross-sectional view of FIG. 5.

FIG. 5 shows a view of the balcony system 100 in longitudinal section, and FIG. 6 shows a view in cross-section. FIGS. 5 and 6 also show a building structure 1, such as a room, and a building opening 10, in this case a window. In the embodiment shown in FIGS. 5 and 6, the balcony system includes a first rail system 270 and a second rail system 280, the first rail system 270 connecting the balcony unit 110 and the top unit 225 in the first connecting region 131 and the second rail system 280 connecting the top unit 225 and the base unit 220 in the second connecting region 231. The base unit 220 includes a basic module 250 formed as a stiffened frame structure having two transversely extending walls 252, 256 longitudinally spaced from each other and an intermediate member longitudinally connecting them. Add-on modules 260, which can give the balcony system 100 the functionality of a piece of furniture, are only schematically indicated in FIGS. 5 and 6.

A first rail 272 and a second rail 276 of the first rail system 270 are mounted on the underside of the balcony unit, the first rail 272 and the second rail 276 being parallel and spaced apart from each other in the transverse direction. A first roller unit 273 and a second roller unit 275 of the first rail system 270, the rollers of which engage with the first rail 272 of the first rail system 270, are spaced apart from each other in the longitudinal direction and are mounted on the upper side of the top unit. Accordingly, a first roller unit 277 and a second roller unit of the first rail system 270, the rollers of which engage the second rail 276 of the first rail system 270, are spaced apart from each other by the same distance in the longitudinal direction and are mounted on the top side of the top unit.

A first rail 282 and a second rail 286 of the second rail system 280 are mounted on the underside of the top unit 225, the first rail 282 and the second rail 286 being parallel and spaced apart from each other in the transverse direction. In FIG. 5, the distances in the transverse direction between the first and second rails of the respective first and second rail systems are the same. A first roller unit 283 and a second roller unit 285 of the second rail system 280, whose rollers engage the first rail 282 of the second rail system 280, are spaced apart from each other in the longitudinal direction and are mounted on respective top surfaces of walls 252, 256 of the basic module 250 of the base unit 220. Accordingly, a first roller unit 287 and a second roller unit of the second rail system 280 having rollers engaging the second rail 286 of the second rail system 280 are spaced apart from each other by the same distance in the longitudinal direction and are also mounted on the respective top surfaces of the walls 252, 256 of the basic module 250 of the base unit 220.

The support element 228 of the top unit 225 has a roller system 290 with four roller units, of which only the two roller units 292, 294 can be seen in FIG. 5, while the other two roller units are parallel and at a distance in the transverse direction. The roller units are mounted on the underside of a body 229 of the support element 228 and can run over the floor 2 of the building structure 1.

Figure 7:
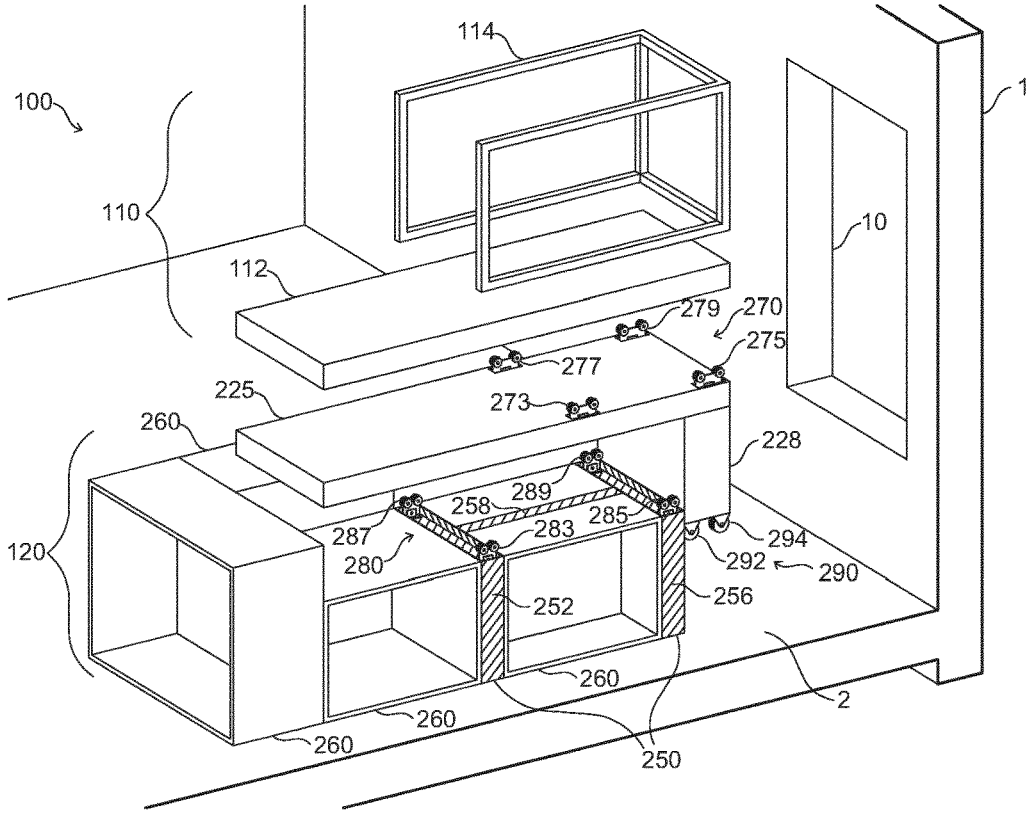
FIG. 7 shows a partial exploded view of a balcony system according to embodiments described herein.
Figure 8:
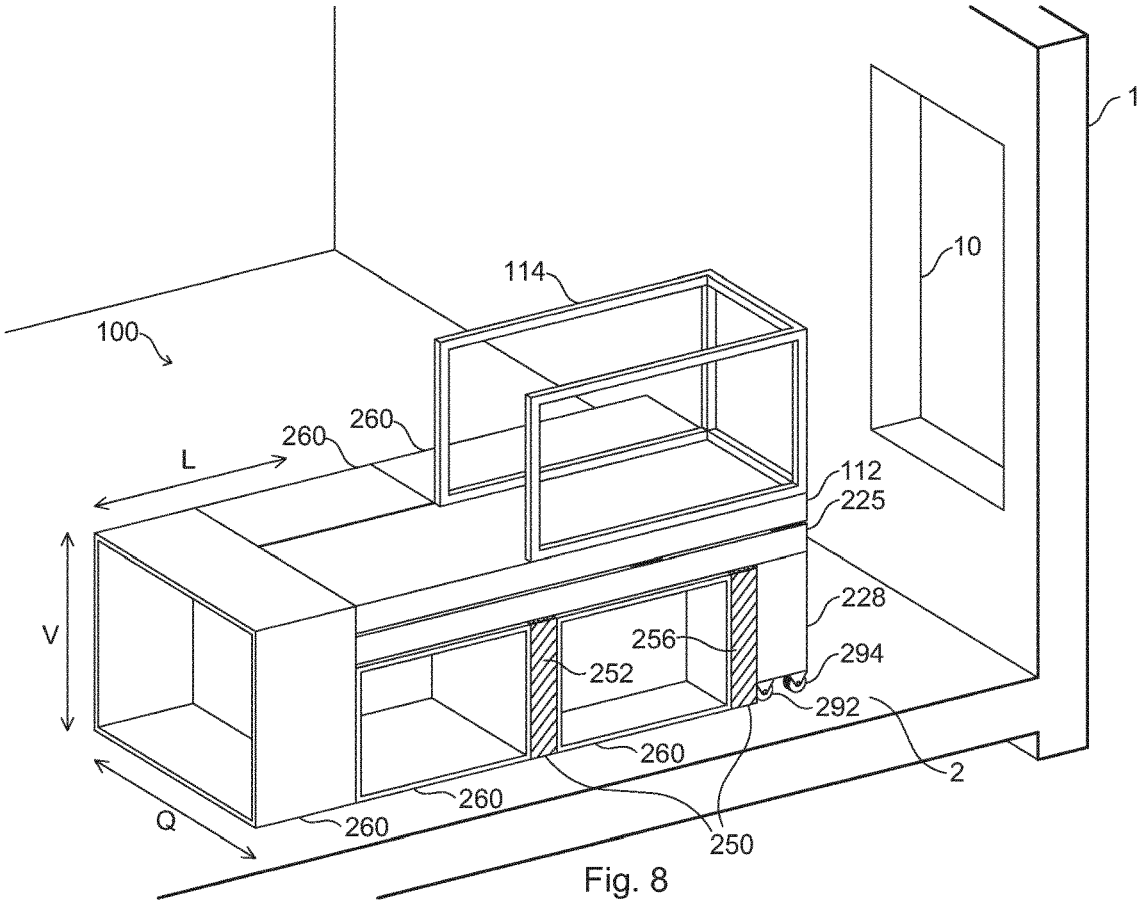
FIGS. 8-10 show a balcony system according to embodiments described herein in perspective view in various states of assembly or disassembly.
Figure 9:
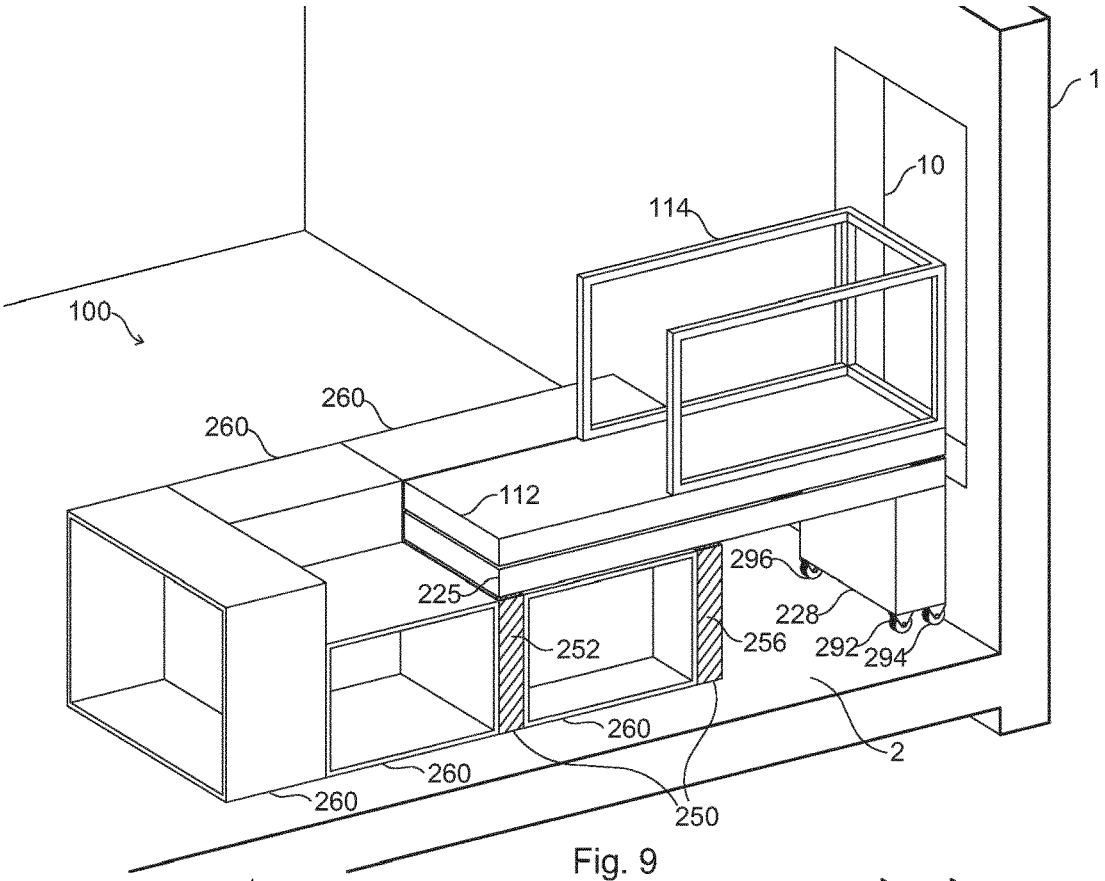
Figure 10:
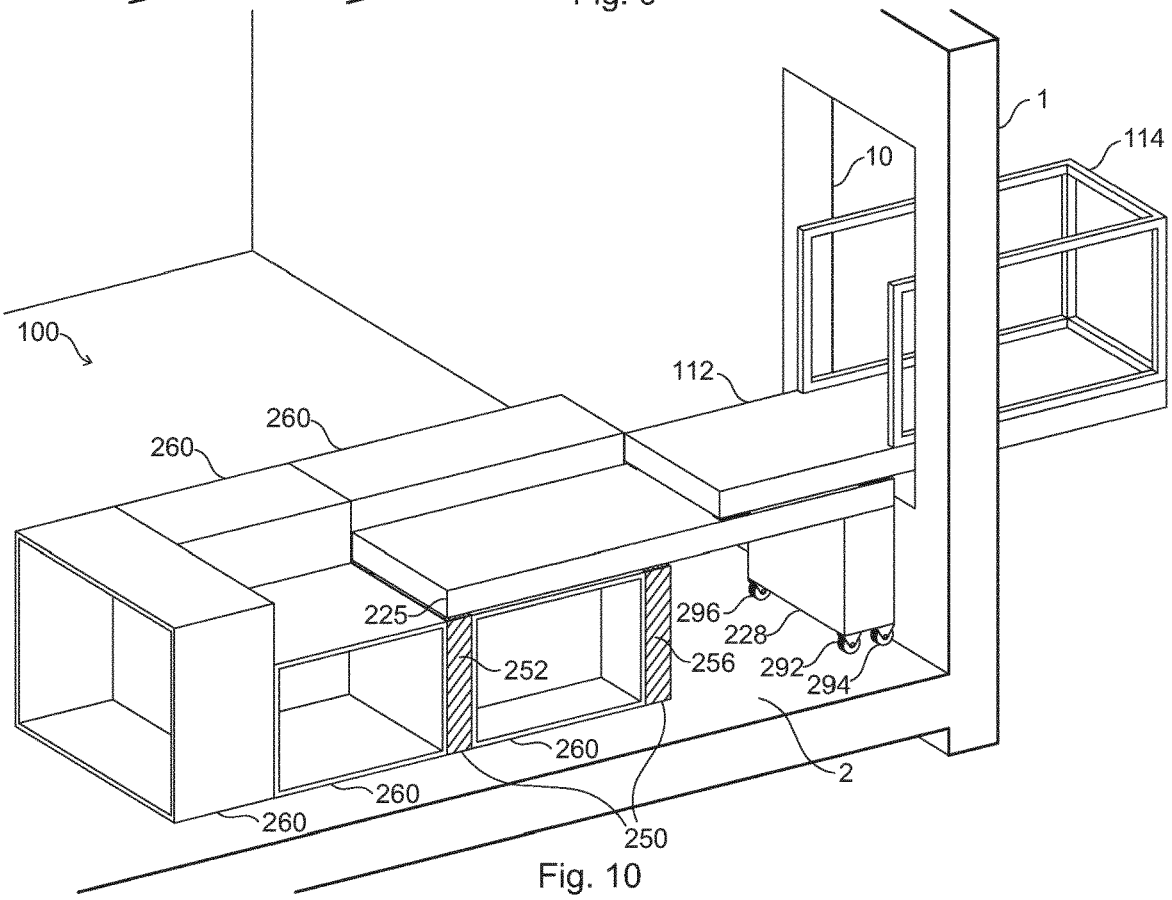

FIG. 7 shows a perspective view of the balcony system 100 showing the top unit 225 with support element 228, the floor 112, and the restraining device 114 in exploded view. FIGS. 8-10 show perspective views of the balcony system 100 in the compactified state, the assembled state, and the balcony state. In FIG. 7, in addition to the roller units 273, 277 of the first rail system visible in FIG. 6, the roller units 279 and 275 at the front end of the top unit 225 are also visible, as are the roller units 285 and 289 of the second rail system in addition to the roller units 283, 287 already visible in FIG. 6. In top view, the stiffened frame structure 250 has the shape of an elongated H, with the walls 252, 256 forming the legs of the H and the connecting wall 258 forming the connecting web of the H. In FIG. 8, the balcony system 100 is in the compactified state, although the balcony unit with floor 112 and restraining device 114 may be further compactified. For clarity, the longitudinal direction, the transverse direction and the vertical direction are represented by double arrows labeled L, Q and V. In FIG. 9, the balcony system 100 is shown in the assembled state. In addition to the roller units 292 and 294 of the support element 228, of further two roller units lying in parallel, the roller unit 296 is visible, which is attached to the underside of the body 229 of the support element at a distance in the transverse direction from the roller units 292, 294. Compared to FIG. 8, the support element 228 has been moved over the floor 2 of the building structure 10 towards the building opening 10, whereby the seated part of the top unit 225 bridges the distance to the building opening and also bridges the parapet height of the building opening at its upper side. As shown in FIG. 10, the balcony unit with its base 112 and the restraining device 114 can now be moved out of the building opening so that the balcony system 100 assumes its balcony state. In this case, the part of the balcony unit projecting beyond the ledge of the building opening represents a temporary outdoor balcony.

Figure 11:
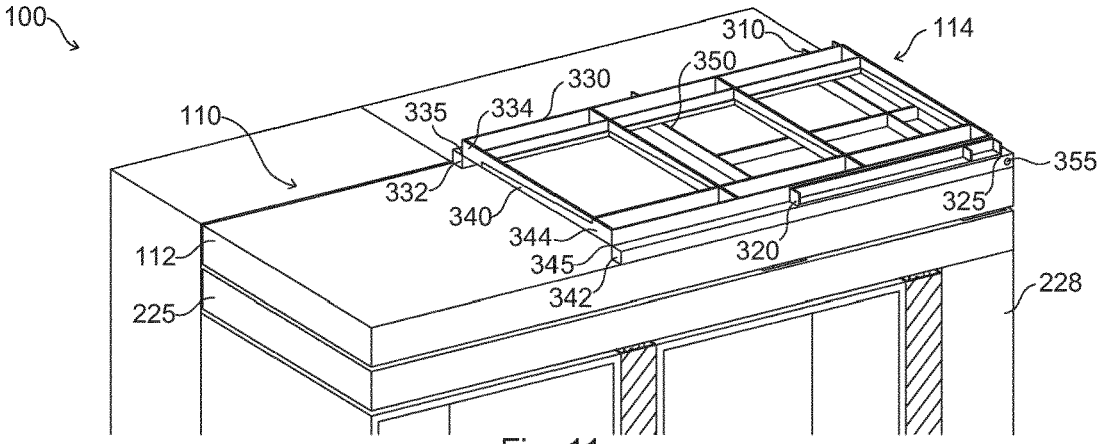
FIGS. 11-13 show a balcony unit of a balcony system according to embodiments described herein in perspective view in various states of assembly or disassembly.
Figure 12:
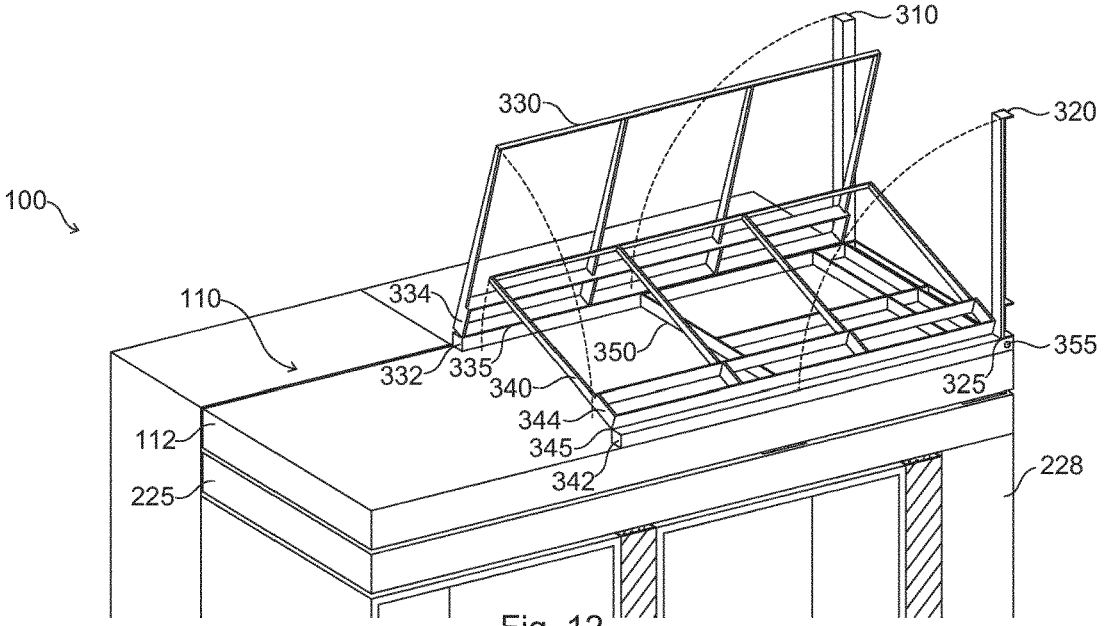
Figure 13:
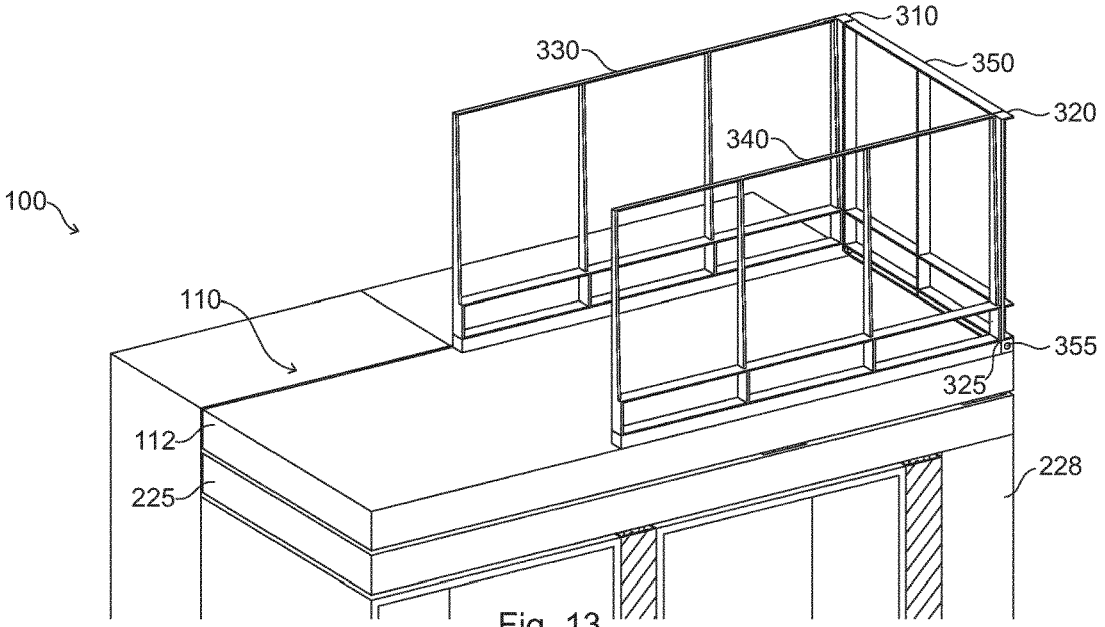
Figure 14:
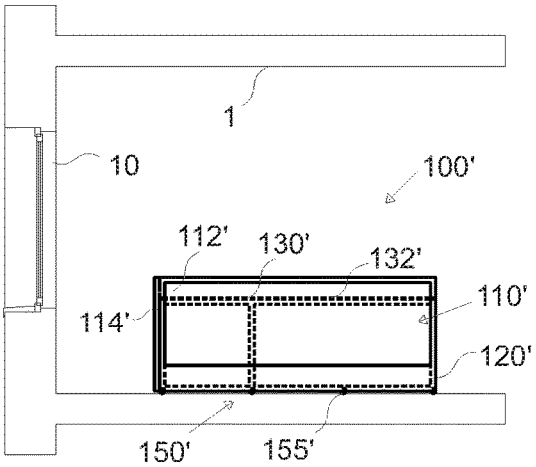
Fig. 14 (Prior art)
FIGS. 14-17 show a known balcony system.
Figure 15:
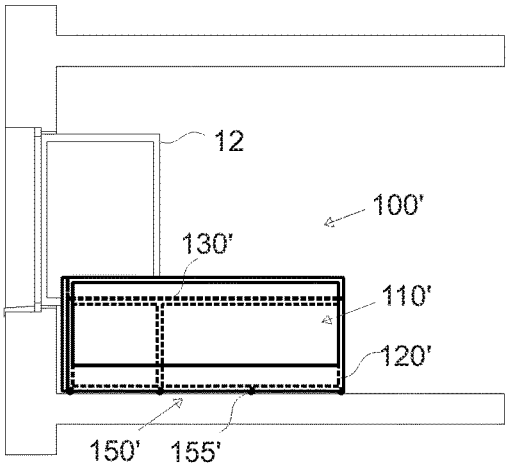
Fig. 15 (Prior art)
Figure 16:
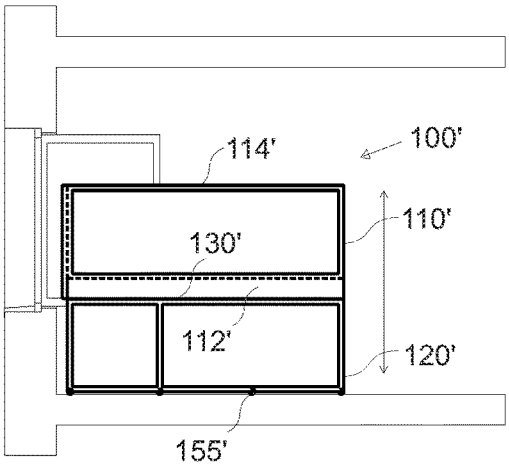
Fig. 16 (Prior art)
Figure 17:
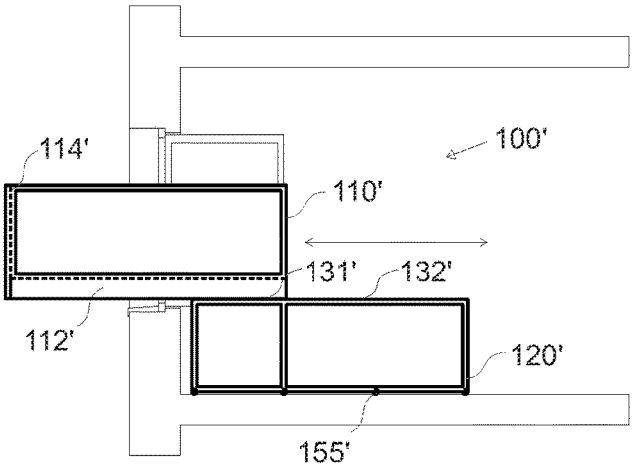
Fig. 17 (Prior art)

FIGS. 11-13 show a perspective view of the balcony system 100 in which the balcony unit is compactifiable in that the restraining device 114 in the form of a railing is configured to be disassembled into component parts and folded in and out. The restraining device 114 includes a first side railing section 330, a second side railing section 340, a frontal railing section 350, a first corner post 310, and a second corner post 320. The side railing sections 330, 340 include respective skirting members 332, 342 mounted longitudinally on the top surface of the floor 112. Parapet portions 334, 344 of the side railing sections 330, 340 are connected to the skirting members 332, 342 by respective hinges 335, 345. The corner posts 310, 320 are also connected to the skirting members 332, 342 via hinges, although of the two hinges only the hinge 315 of the first corner post 310 is visible. The frontal railing section 350 is connected to the skirting members 332, 342 by a hinge 355 and extends at the front end of the floor between the skirting members 332, 342.

FIG. 11 shows the balcony unit 110 in the compactified state, in which the front railing section 350 is folded in between the skirting members 332, 342, the parapet part 344 of the second side railing section 340 is folded in over the front railing section 350, the parapet part 334 of the first side railing section 330 is folded in over the parapet part 344, the first corner post 310 is folded in over the first skirting member 332 and the second corner post 320 is folded in over the second skirting member 342. FIG. 12 illustrates the structure of the restraining device 114 with first the two corner posts 310, 320 being unfolded vertically, then the parapet portion 334 of the first side railing section 330, then the parapet portion 344 of the second side railing section 340, and finally the frontal railing section 350. The directions of movement are indicated by dashed lines. FIG. 13 shows the balcony unit 110 in the assembled state. The undersides of the parapet sections 334, 344 as well as the undersides of the corner posts 310, 320 come to rest on the skirting members 332, 342 so that, in interaction with the respective hinges, a folding movement beyond the vertical is blocked. Similarly, the underside of the frontal railing section 350 comes to rest on the floor 112 so that folding movement beyond the vertical is blocked in cooperation with the hinge 355. Each of the railing sections is adapted to detachably connect to the respective adjacent railing section(s). In this manner, the restraining device 114 fulfills its function of restraining persons or objects. A balcony system could be configured such that its assembly is in the sequence of FIGS. 11, 12, 13, 8, 9, 10 in that order, and its disassembly is correspondingly the other way around.

According to further embodiments, a building structure is provided. This building structure includes a building opening and a balcony system according to embodiments described herein. The building opening may have the dimensions and parapet height of a window. The base unit of the counterforce unit may be stationarily placed on a floor of the building structure. The top unit of the counterforce unit can be moved with its front end to the building opening, or be movable in this manner. The balcony unit can protrude through the building opening or be movable through the building opening.

Further embodiments relate to the use of a balcony system according to one of the embodiments described herein as a temporary balcony. In this regard, the balcony unit serves as a balcony. The balcony, or balcony unit, may be adapted for use for a building opening, such as a window.

According to further embodiments, a method for setting up a temporary balcony is provided. The method includes setting up a balcony system described herein in a building structure having a building opening, wherein setting up the balcony system includes setting up the base unit of the balcony system stationary with respect to the building structure. The method includes moving the top unit relative to the base unit so that the balcony unit connected to the top unit is moved in front of the building opening. The method includes moving the balcony unit relative to the top unit so that the balcony unit projects from the building opening. Further, the functionalities of the described components of the balcony system directly and immediately result in further process steps that implement, or exploit, these functionalities. If, for example, a component is described as being movable, the process step of moving this component, etc., is directly derivable as a consequence.

According to further embodiments, the base unit can be a height-adjustable base unit. Consequently, the counterforce unit as a whole is then also height-adjustable. The base unit may be arranged to assume a flat state and a high state. The height of the base unit in the high state, together with the height of the seated part of the top unit resting on the base unit, can form an operating height of the counterforce unit that corresponds at least to the parapet height of the building opening, e.g. at least 60 cm or at least 90 cm high. The height of the base unit in the high state may be more than 60%, more than 70%, more than 80% or even more than 90% of the total operating height of the counterforce unit. Thus, the height of the base unit in the high state can substantially compensate for the parapet height of the building opening. The height of the base unit in the flat state, together with the height of the seated portion of the top unit resting on the base unit, may form a base height of the counterforce unit. The base height of the counterforce unit may be less than 60 cm, less than 50 cm, or even less than 40 cm. The height of the base unit in the flat state can be smaller than 50 cm, smaller than 40 cm or even smaller than 30 cm.

A height-adjustable base unit can include a lifting system. The lifting system may be arranged to transfer the base unit from the flat state to the high state and vice versa. The lifting system may be mechanical, electromechanical, hydraulic, or a combination thereof. The lifting system may include a scissor lift. The scissor lift may include a base plate. The base plate may correspond to or be a part of the base plate of the structural module. The scissor lift may include a top plate. The scissor lift may include one, two, or more scissors. The scissor or scissors of the scissor lift may be located between and connected to the base plate and the top plate. The top surface of the top plate may form the top surface of the base unit. The scissor lift may be manually or electrically operated.

Figure 18:
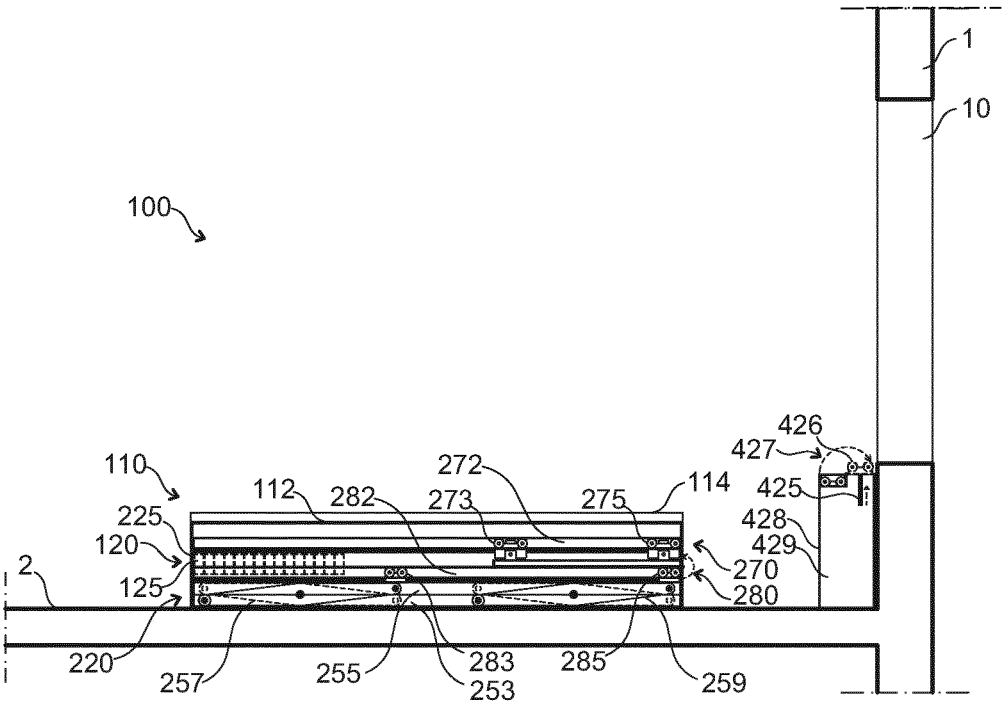
FIGS. 18-19 show a balcony system according to embodiments described herein.
Figure 19:
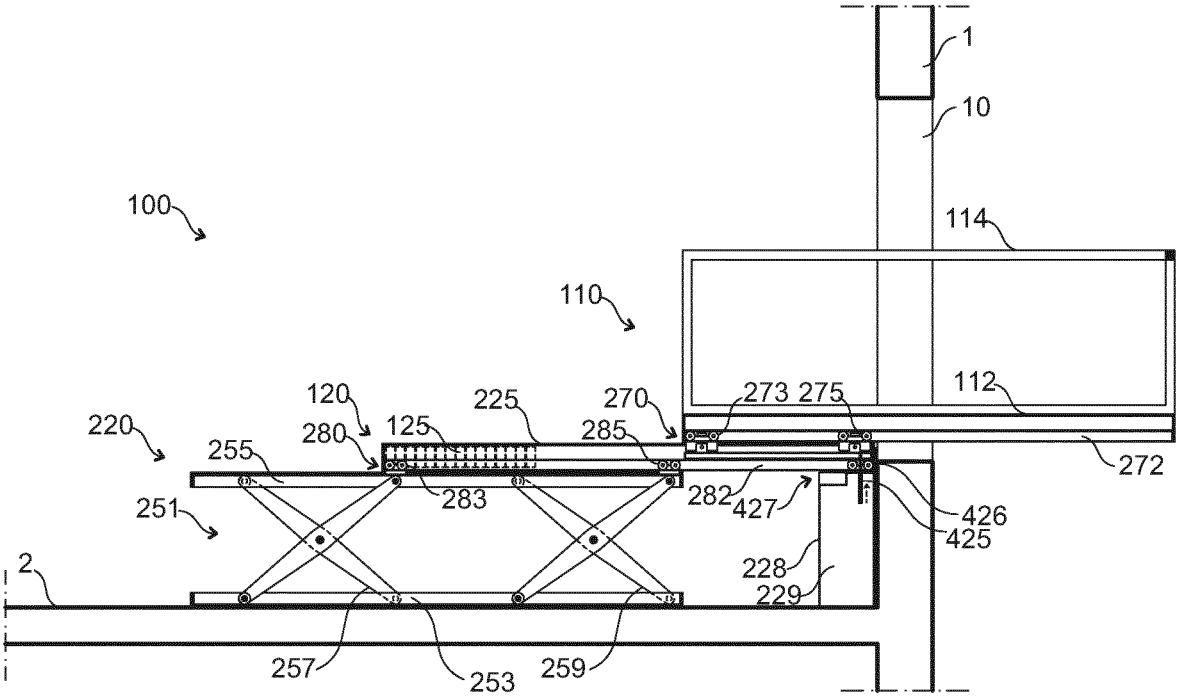

FIGS. 18 and 19 show an embodiment of the balcony system 100, which has a height-adjustable base unit 220. Here, FIG. 18 shows the height-adjustable base unit 220 in the flat state and correspondingly the counterforce unit 120 in the basic state, while FIG. 19 shows the height-adjustable base unit 200 in the high state and correspondingly the counterforce unit 120 in the operating state. The height adjustable base unit 220 includes a scissor lift 251 having a base plate 253, a top plate 255, a first scissor 257 and a second scissor 259. In this embodiment, the top unit 225 does not include a dedicated support element. Instead, the balcony system includes a structural module that includes a touchdown element 428. The touchdown element 428 includes a body 429 and a connector 427. The touchdown element 428 is fixedly located at the building opening 10 and extends vertically, such that the height of the touchdown element 428 is equal to the height of the base unit 220 in the high state. The touchdown element 428 is thus sized to allow the top unit 225 to touch down and rest on the touchdown element 428 when extended. The connecting piece 427 ensures that the top unit 225 slides onto the touchdown element 428 and can connect the two parts in a force-fit manner, whereby the connection can be released. A connection piece of the touchdown element may include one or more elements selected from the group consisting of: rollers, bolts, latches, screws and clips. In the embodiment shown, the connector 427 includes a pair of rollers 426 onto which the top unit 225 can slide and a bolt 425 that releasably connects the top unit 225 and the touchdown element 428. The combination of roller pair 426 and bolt 425 connects the top unit 225 and the touchdown element 428 flush with each other. The pair of rollers 426 is designed to be retractable so that it is subject to less contamination when retracted, as shown in FIG. 18, while at the same time the surface of the touchdown element 428 can serve as a storage surface or the like.

The foregoing relates to embodiments of the invention. However, other and further embodiments may arise without departing from the scope resulting from the following claims.

The invention claimed is:

1. A balcony system for use with a building opening of a building structure, the balcony system comprising:

a balcony unit adapted to project out of the building opening;

a counterforce unit adapted to compensate for forces acting on the balcony unit; and a first connecting element connecting the balcony unit and the counterforce unit, wherein the counterforce unit comprises a base unit, a top unit and a second connecting element, wherein the base unit is adapted for stationary installation on a floor of the building structure with respect to the building structure, and wherein the first connecting element connects the balcony unit and the top unit, and the second connecting element connects the top unit and the base unit, wherein the top unit is horizontally movable relative to the base unit that is installed in a stationary way on the floor of the building structure.

2. The balcony system of claim 1, wherein the second connecting element comprises a rail on the underside of the top unit.

3. The balcony system according to claim 1, wherein the first connecting element connects the balcony unit and the top unit in a first connecting region by a first rail system.

4. The balcony system of claim 3, wherein the first rail system comprises a first rail on the underside of the balcony unit and comprises two spaced apart roller units disposed on the top of the top unit, the rollers of which engage the first rail on the underside of the balcony unit.

5. The balcony system of claim 1, wherein the second connecting element connects the top unit and the base unit in a second connecting region by a second rail system, wherein the second rail system comprises a rail on the underside of the top unit.

6. The balcony system of claim 5, wherein the second rail system comprises two spaced apart roller units disposed on the top of the base unit, the rollers of which engage the rail on the underside of the top unit.

7. The balcony system according to claim 1, wherein the balcony unit is movable relative to the top unit by the first connecting element.

8. The balcony system according to claim 1, wherein the counterforce unit comprises a counterweight for compensating at least a major part of the forces acting on the balcony unit, the counterweight being arranged in the top unit.

9. The balcony system according to claim 1, wherein the top unit comprises a support element adapted for force transmission to the building structure before, during and after relative movement between the top unit and the base unit that is stationary with respect to the building structure.

10. The balcony system of claim 9, wherein the support element comprises a roller.

11. The balcony system according to claim 1, wherein the top unit is configured as a linearly movable clamped beam.

12. The balcony system according to claim 1, wherein the top unit is configured as a linearly movable clamped beam supported at a front end.

13. The balcony system according to claim 1, wherein the base unit comprises a basic module, wherein the basic module is arranged to absorb forces exerted by the balcony system and to transmit them to the floor of the building structure.

14. The balcony system according to claim 1, wherein the base unit comprises a basic module and a structural module, wherein the basic module is arranged to absorb forces exerted by the balcony system and to transmit them to at least one of the floor of the building structure and the structural module.

15. The balcony system of claim 14, wherein the structural module is configured to compensate for at least one of floor unevenness and floor inclinations of the floor of the building structure, and to distribute forces exerted by the balcony system over a floor area of the floor of the building structure, wherein the structural module comprises at least one component from the group consisting of a floor plate, a beam and a base.

16. The balcony system of claim 1, wherein the base unit comprises an add-on module, wherein the add-on module is adapted for stationary installation with respect to the building structure, and wherein the add-on module makes the base unit a piece of furniture.

17. The balcony system according to claim 1, wherein the height of the counterforce unit is at least a parapet height of a parapet of the building opening, wherein the height of the base unit is greater than the height of the top unit.

18. The balcony system according to claim 1, wherein the balcony system has at least one of the following properties:

a) the balcony system is a statically closed system;

b) the counterforce unit is set up to compensate for forces acting on the balcony unit without interfering with the building structure;

(c) the balcony system is essentially building structure non-invasive.

19. Use of a balcony system as a temporary balcony for a building opening, such as a window, the balcony system comprising:

a balcony unit adapted to project out of the building opening;

a counterforce unit adapted to compensate for forces acting on the balcony unit; and a first connecting element connecting the balcony unit and the counterforce unit, wherein the counterforce unit comprises a base unit, a top unit and a second connecting element, wherein the base unit is adapted for stationary installation with respect to a building structure on a floor of the building structure, and wherein the first connecting element connects the balcony unit and the top unit, and the second connecting element connects the top unit and the base unit, wherein the top unit is horizontally movable relative to the base unit that is installed in a stationary way on the floor of the building structure.

20. A method for setting up a temporary balcony, comprising:

setting up a balcony system in a building structure having a building opening, wherein the balcony system comprises:

a balcony unit adapted to project out of the building opening;

a counterforce unit adapted to compensate for forces acting on the balcony unit; and a first connecting element connecting the balcony unit and the counterforce unit, wherein the counterforce unit comprises a base unit, a top unit and a second connecting element, wherein the first connecting element connects the balcony unit and the top unit, and the second connecting element connects the top unit and the base unit, wherein setting up the balcony system comprises setting up the base unit of the balcony system stationary with respect to a building structure on a floor of the building structure;

horizontally moving the top unit relative to the base unit that is installed in a stationary way on the floor of the building structure so that the balcony unit connected to the top unit is moved in front of the building opening; and moving the balcony unit relative to the top unit so that the balcony unit protrudes from the building opening.

* * * * *